United States Patent [19]

Holter

[11] 4,159,776

[45] Jul. 3, 1979

[54] TOWER CRANE

[75] Inventor: Carl F. Holter, Cedar Rapids, Iowa

[73] Assignee: FMC Corporation, San Jose, Calif.

[21] Appl. No.: 825,890

[22] Filed: Aug. 19, 1977

Related U.S. Application Data

[63] Continuation of Ser. No. 668,366, Mar. 19, 1976, abandoned.

[51] Int. Cl.[2] ..... B66C 23/62

[52] U.S. Cl. ..... 212/59 R; 212/49

[58] Field of Search ..... 212/46, 48, 49, 59 R

[56] References Cited

U.S. PATENT DOCUMENTS 3,664,516 5/1972 Goudy ..... 212/46 A

FOREIGN PATENT DOCUMENTS

| | | | |
|---|---|---|---|
| 810893 | 6/1951 | Fed. Rep. of Germany | 212/46 A |
| 1100248 | 2/1961 | Fed. Rep. of Germany | 212/46 A |
| 1248257 | 8/1967 | Fed. Rep. of Germany | 212/46 B |
| 1900987 | 7/1970 | Fed. Rep. of Germany | 212/46 R |
| 401625 | 2/1974 | U.S.S.R. | 212/46 R |

*Primary Examiner*—Lawrence J. Oresky
*Attorney, Agent, or Firm*—J. F. Verhoeven

[57] ABSTRACT

A tower crane is disclosed in which a balance arm is pivotally connected to the top of the tower on an axis midway between the front edge of the tower and the rear edge thereof. The front end of the balance arm extends beyond the front edge of the tower, and a boom to support a load is connected to said front end of the arm. A backstay exerts a downward force on the rear end of the balance arm to balance the load. The load carried by the boom is therefore distributed equally to the four corner chords of the tower.

4 Claims, 7 Drawing Figures

FIG_3
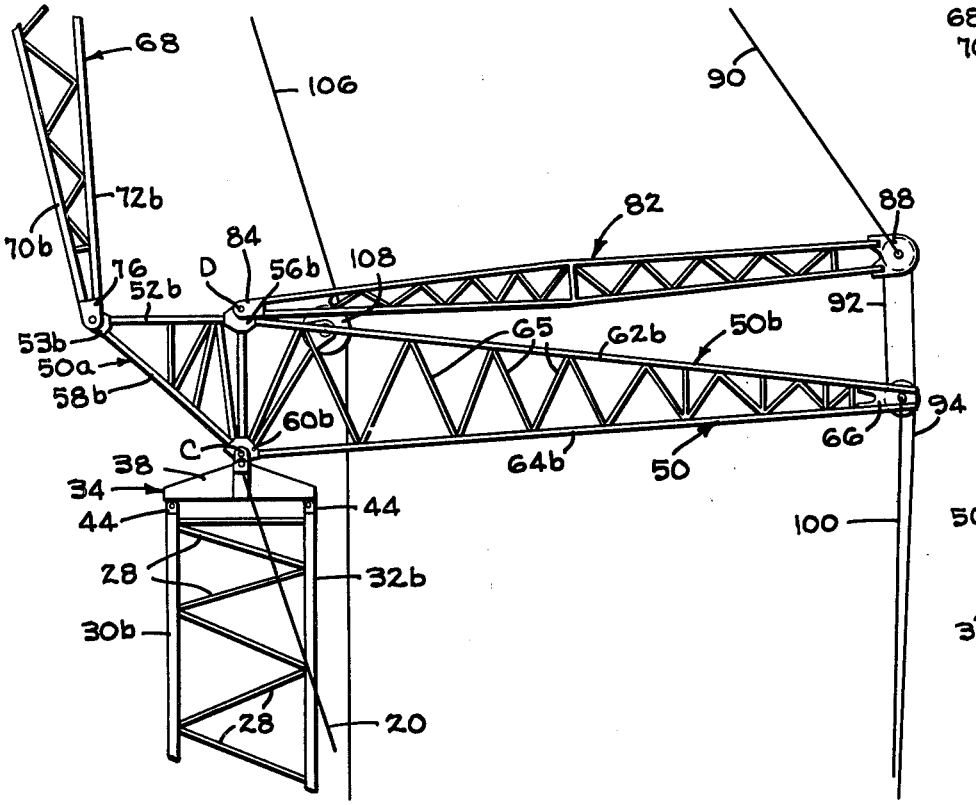
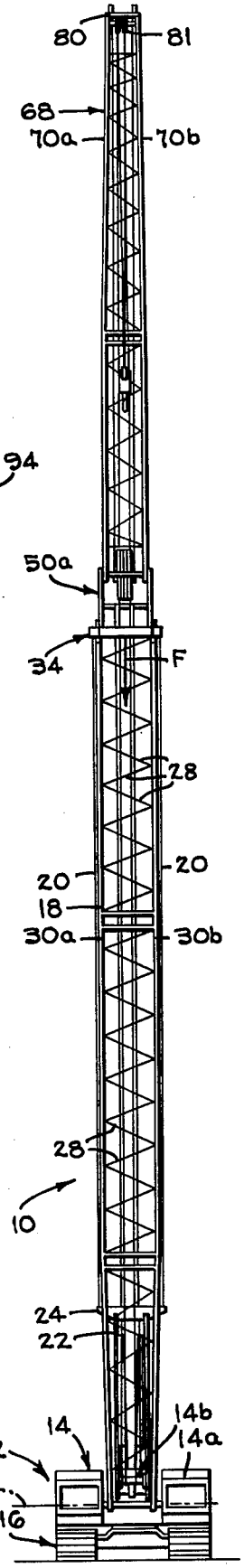
FIG_2

LOAD "X"
81
68
106
90
50a
D
108
82
92
94
100
50
50b
106
32b
C
34
F
30b

TOWER CRANE

This is a continuation, of application Ser. No. 668,366 filed Mar. 19, 1976 now abandoned.

BACKGROUND OF THE INVENTION

1. Field of the Invention

The present invention relates to a tower crane and, more particularly, to mechanism on the tower for supporting the load.

2. Description of the Prior Art

In a tower crane, it is convenient to have the boom, which is supported by the tower, foldable down along the front of the tower for dismantling and/or transport. To accomplish this, it is common to pivotally mount the boom on the front edge of the tower, as shown, for example, in U.S. Pat. Nos. 3,134,488; 3,246,769; 3,252,585; 3,767,061; 3,804,264; 3,844,418; 3,856,160; 3,300,361. Pivotally connecting the load-carrying boom, however, to the front edge of the tower produces an eccentric loading on the tower. Such an eccentric loading on the tower limits the magnitude of the load which can be handled by the boom.

There have, in the past, been tower cranes with a boom foldable along the front edge of the tower in which eccentric loading of the tower was avoided. For example, in U.S. Pat. No. 3,794,184, the boom is pivotally connected centrally of a plate which is connected to the top of the tower boom to center the load of the boom on the tower. The plate, however, can be pivoted about the front edge of the tower to permit the boom to be lowered. Another example of a tower crane in which a centrally mounted boom on the tower can be folded along the front edge of the tower is shown in U.S. Pat. No. 3,433,368. In this crane, the boom has a laterally extending foot extension which is pivotally connected at the top of the tower between the front and rear edges of the tower.

SUMMARY OF THE INVENTION

In the present invention, a simpler, more effective and versatile structure is provided for mounting a load handling member on the tower so that the load will be centrically supported by the tower. At the same time, the boom can be swung down along the front edge of the tower for dismantling. In brief, in the preferred form of the invention, a balance arm is pivotally connected to the top of the tower on an axis midway between the front edge of the tower and the rear edge thereof. The load handling member, such as a pivotal boom, is mounted on the front end of the balance arm which extends beyond the front edge of the tower. Means, such as a backstay, is provided to exert a downward force on the rear end of the balance arm to hold the balance arm in a horizontal position during operation of the boom. The backstay thus balances the load carried by the boom. Since the balance arm is connected to the tower only on a central axis, and is mounted pivotally on said axis, the load from the boom is transmitted to the tower centrically to avoid overloading of the front tower chords. At the same time, the boom can be swung down along the front edge of the tower.

It is therefore one object of the present invention to achieve centric loading on the tower of a tower crane of a load carried at point forward of the front edge of the tower.

It is another object of the present invention to balance on a central axis on the tower of a tower crane a load carried beyond the forward edge of said tower.

It is still another object of the present invention to provide on a tower crane a mounting structure to permit a boom to be folded along the front of the tower while centering the load of the boom on the tower.

BRIEF DESCRIPTION OF THE DRAWINGS

FIG. 2 is a view taken on the line 2—2 of FIG. 1.

FIG. 3 is an enlarged side view of the balance arm of the present invention.

DESCRIPTION OF THE PREFERRED EMBODIMENTS

Figure 1:
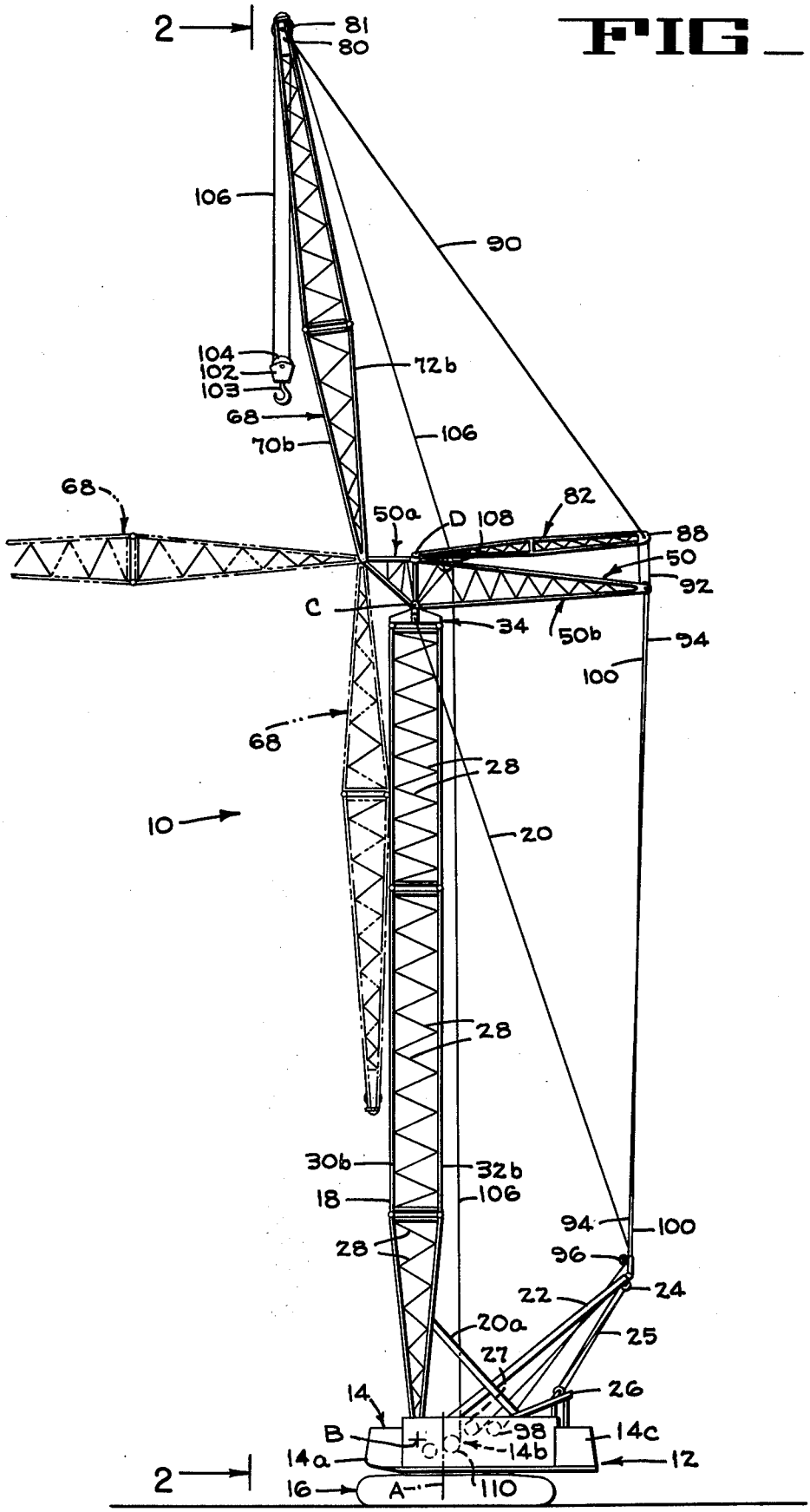
FIG. 1 is a side elevational view of a tower crane embodying the present invention.

There is shown in FIG. 1 a tower crane 10 having a base 12 which is defined by an upper works 14 rotatably mounted on a lower works 16. The lower works may be a crawler chassis, as shown, or a wheeled chassis, and the upper works swings on the lower works about a vertical axis A. The upper works includes a cab **14*a* for the operator, machinery 14*b* for hoisting a load, and a counterweight 14*c***.

A tower 18 is pivotally connected to the upper works 14 for swinging in a vertical plane about an axis B. The tower is elevated to a vertical operating position, and is maintained in the vertical operating position, by tower pendants 20 which are connected to the outer end of a tower live mast 22 and by tower stops **20*a*. The live mast 22 has a tower hoist bridle 24 at the outer end, and is lowered by tower hoist reeving 25 which is received on a tower hoist bail 26 and powered by winch 27**.

Figure 4:
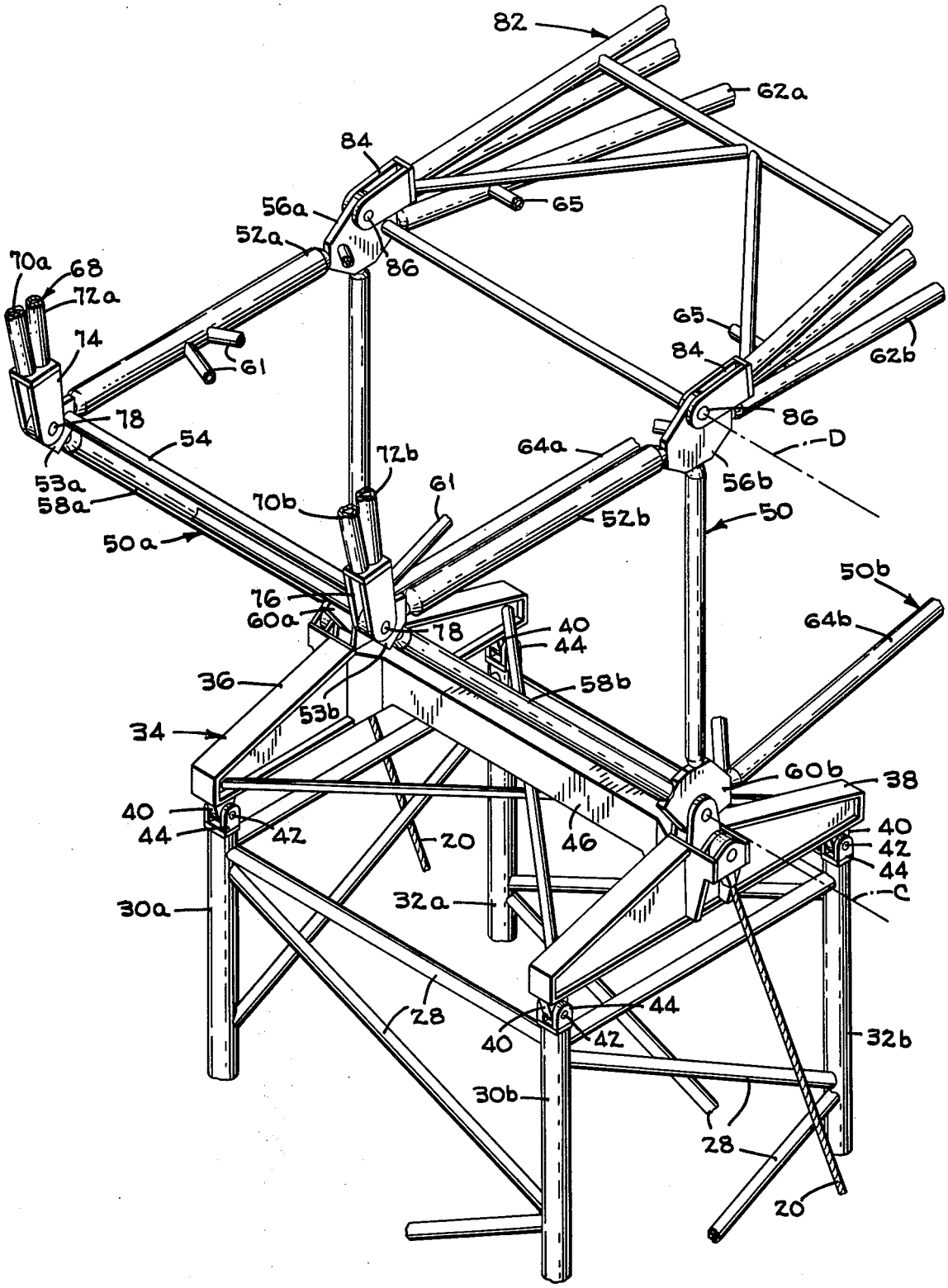
FIG. 4 is an enlarged view of the pivotal connection of the balance arm to the tower.

The tower 18, as shown for illustrative purposes, is of welded box lattice construction, rectangular, with four corner chords interconnected by bracing 28, as shown best in FIG. 4. The chords consist of two front chords **30*a*, 30*b* (lying in a front common plane) and two rear chords 32*a*, 32*b* (lying in a rear common plane parallel to the front common plane). The four corner chords connect, at their upper end, to a cap 34 of the tower. The cap has side members 36 and 38, each of which has downwardly extending ears 40 at each end pivotally pinned, as at 42, in a clevis 44 mounted on the top of each tower chord. The cap has a laterally extending bar 46** connecting the two side members.

A balance arm 50 (FIG. 3) is pivotally mounted to the cap on a laterally extending axis C midway between the front tower chords **30*a*, 30*b* and the rear tower chords 32*a*, 32*b*. As shown in FIGS. 1 and 3, the balance arm has a forward portion 50*a* extending forwardly of axis C and a rear portion 50*b* extending rearwardly of axis C. The front balance arm portion has upper longitudinal chords 52*a*, 52*b* (see FIG. 4) which terminate at their outer ends at junction plates 53*a*, 53*b* and at their inner ends at upper junction plates 56*a*, 56*b*. A laterally extending bar 54 connects junction plates 53*a*, 53*b*. Support chords 58*a*, 58*b* slope downwardly from the junction plates 53*a*, 53*b* to lower junction plates 60*a*, 60*b*. Bracing 61** extends between the chords.

The rear balance arm portion has upper longitudinal chords **62*a*, 62*b* extending rearwardly from the upper junction plates 56***a*, 56*b* and has lower longitudinal chords 64*a*, 64*b* extending rearwardly from the lower junction plates 60*a*, 60*b*, with bracing 65 extending between the chords of this portion. The upper and lower chords converge and both pairs of chords are connected to a sheave block 66 which defines a boom hoist bail.

A tower boom 68 has front chords 70*a*, 70*b* and rear chords 72*a*, 72*b*, as shown in FIG. 4. The front and rear chord on each side of the boom converge at the lower end for connection, respectively, to two spaced apart clevises 74, 76 on the front portion of the balance arm. The clevises 74, 76 are pinned, as at 78, to the outer junction plates 53*a*, 53*b* respectively of the forward portion of the balance arm. The tower boom chords also converge at the upper end for connection to a sheave block 80 with sheaves 81 therein.

A boom live mast 82 terminates in clevises 84 which are pinned, as at 86, to the upper junction plates 56*a*, 56*b*, respectively, of the balance arm. The boom live mast can thus pivot in a vertical plane with respect to the balance arm about axis D which is in the same vertical plane as axis C. The outer end of the live mast has a sheave block 88 which defines a boom live mast bridle.

A pair of boom pendant lines 90 are connected, at one end, to the top of the tower boom 68 and, at the other end, to the outer end of the boom live mast 82. Boom hoist reeving 92 between the boom live mast bridle 88 and the balance arm bail 66 includes a pair of boom hoist ropes 94 which pass over sheave 96 and extend to winch 98. A pair of balance arm backstay lines 100 are connected between the outer end of the balance arm rear portion and the outer end of tower live mast 22.

A sheave block 102, with hook 103 and sheaves 104, is supported on the outer end of tower boom 68 by means of hoist lines 106. Line 106 has one end connected to the outer end of boom 68, and passes around sheave 104 and sheave 81. The hoist line 106 passes over sheave 108 mounted on the balance arm and terminates at a winch 110.

Figure 5:
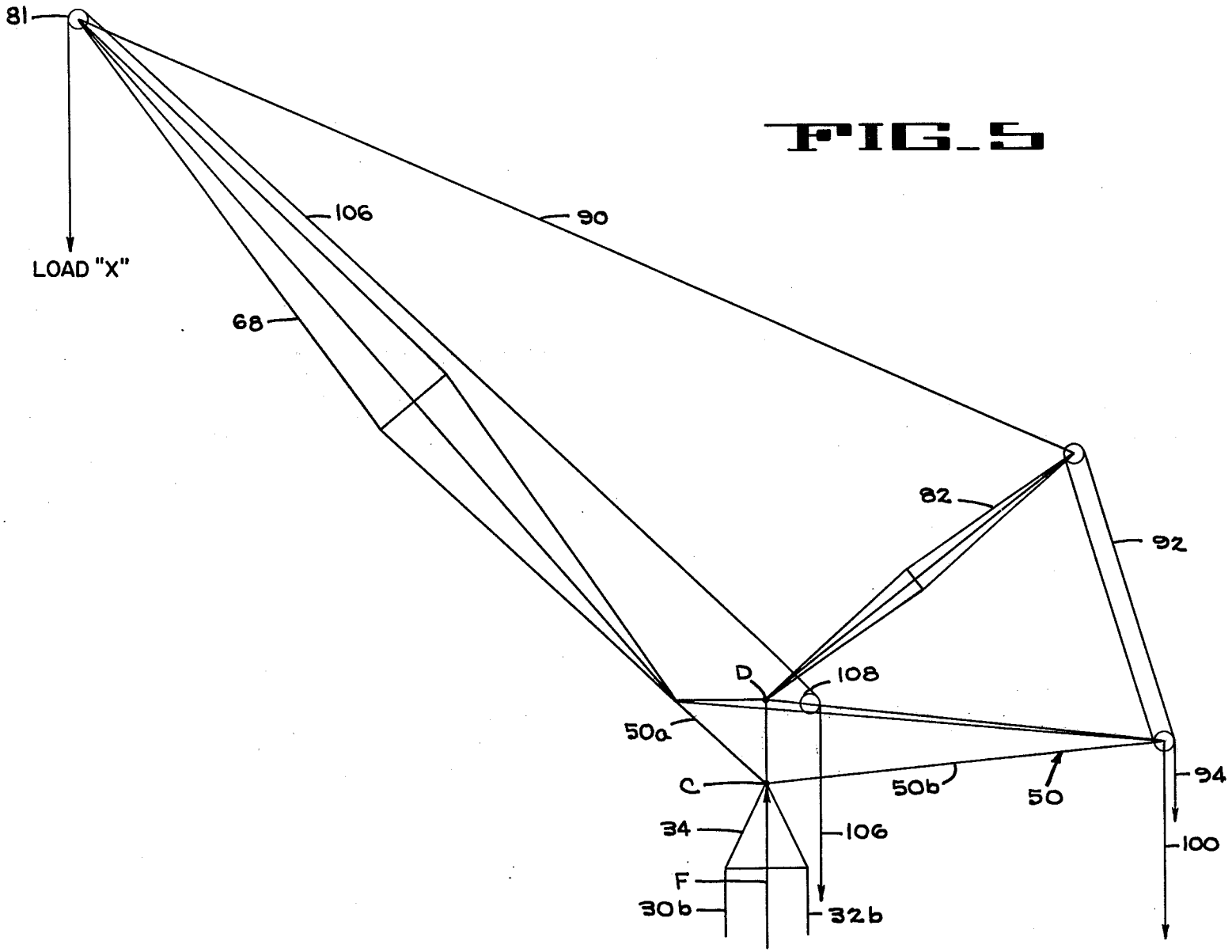
FIGS. 5, 6 and 7 are schematic views of a portion of the tower crane showing the forces acting on the balance arm.

It will be noted that the boom is mounted on the balance arm forward of the front chords of the tower so that the boom can be folded down alongside the tower for dismantling and/or transport. Consequently, as shown in FIG. 5, the weight of the load is transmitted through the boom 68 to the front portion 50*a* of the balance arm. The moment exerted by the weight of the load and the weight of the boom is balanced by an opposing moment exerted by tension in the backstay lines 100, boom hoist lines 94 and hoist line 106 acting on the rear portion 50*b* of the balance arm. Since the balance arm is pivotally connected to the tower cap on a lateral axis C midway between the front chords and the rear chords of the tower, all forces exerted by the weight of the load, the weight of the boom, the weight of the balance arm and live boom mast, and the tension in the backstay, will be transmitted to the tower in a vertical plane passing through axis C. Moreover, since all of the forces exerted by or through the balance arm on the tower are centered between the chords 30*a*, 32*a* on one side of the tower on the one hand, and the chords 30*b*, 32*b* on the other side of the tower on the other hand, the resultant load on the tower will be centered between the sides of the tower along a central vertical (when the tower is vertical) line of force F. Since the line of force F (FIGS. 2 and 5) is centered between all four chords of the tower, all the chords will support an equal portion (one-quarter) of the total force exerted by and through the balance arm.

Figure 6:
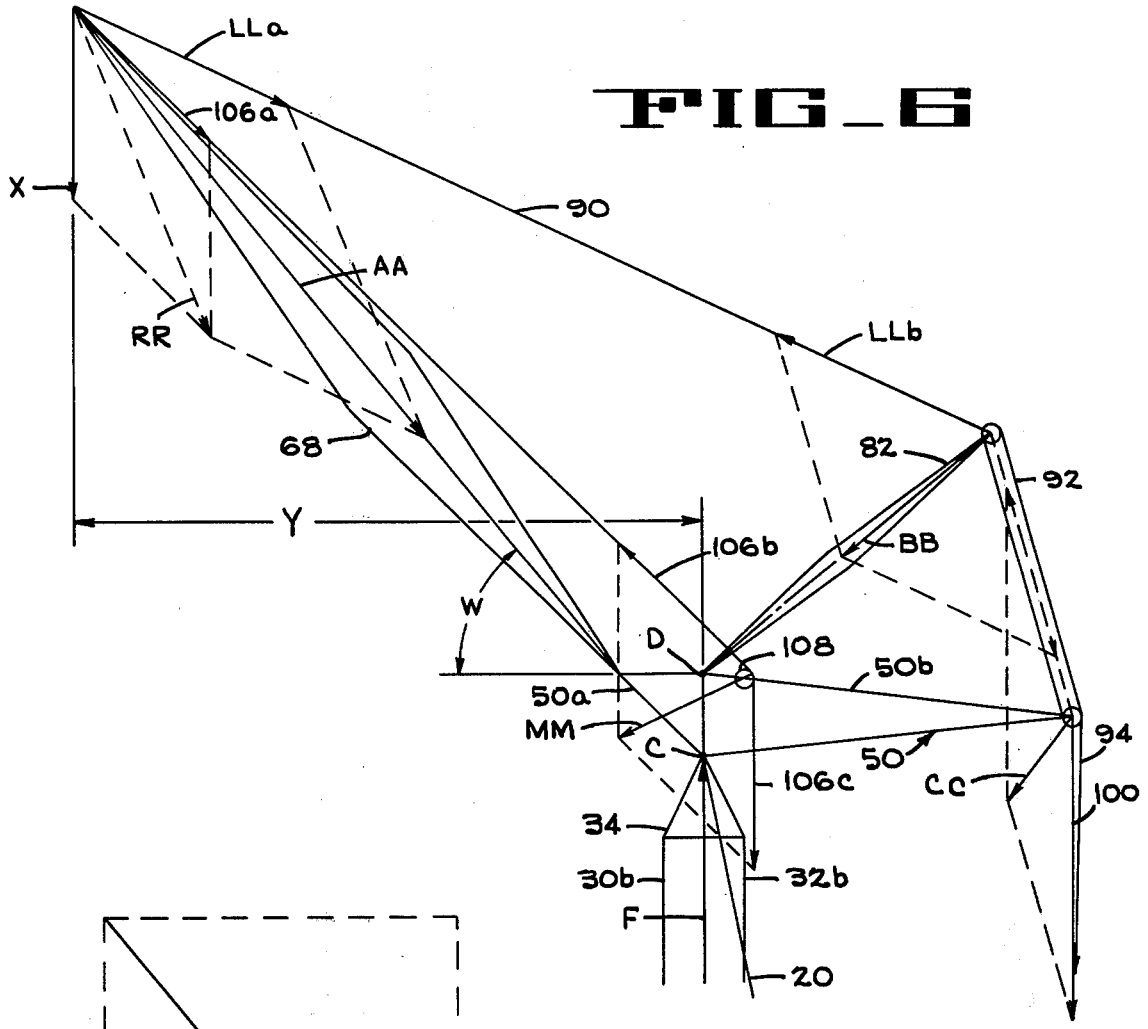
Figure 7:
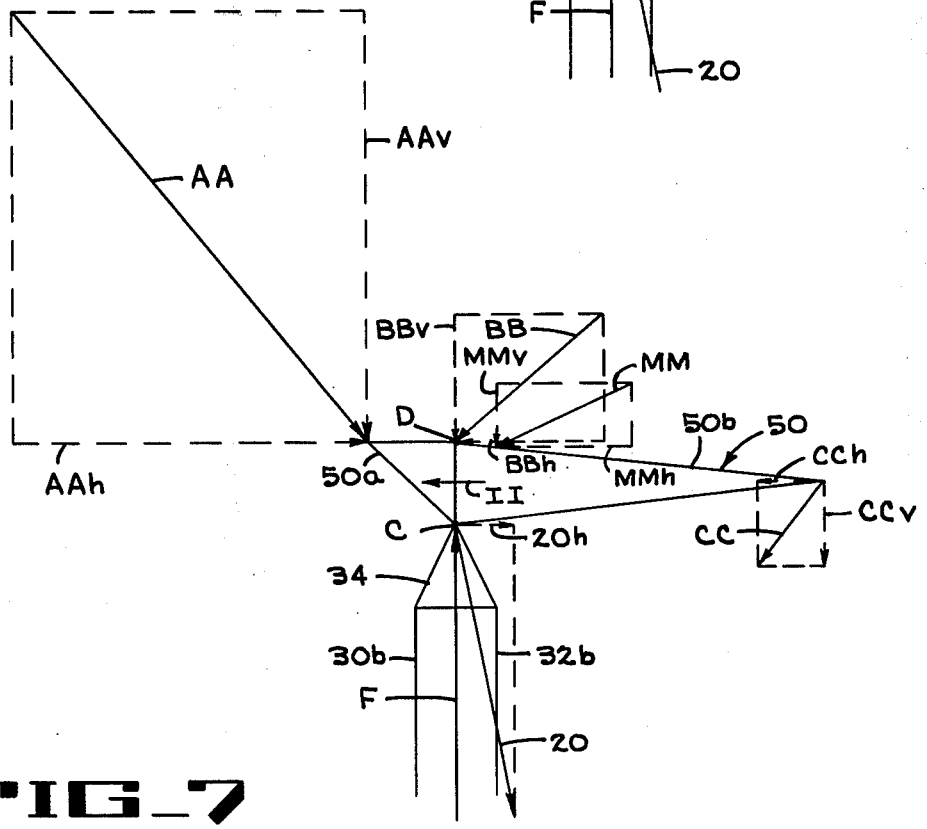

More specifically, as shown in FIG. 6, in the working range W the boom 68 is positioned to lift a load X at a given radius Y. The working load (indicated as a force vector X) must be equal to or less than the rated lifting capacity of the attachment at Y radius. When the load X is raised off of the ground, load X and hoist line 106*a* cause resultant force vector RR. Resultant force vector RR and pendant pull LLa cause boom compression AA. Pendant pull LLb and boom hoist pull in reeving 92 cause boom live mast compression BB. Boom hoist pull in reeving 92 and a pair of boom hoist ropes 94 together with balance arm backstay lines 100 cause balance arm compression CC. Hoist line 106*b* and 106*c* cause force vector MM at sheave 108. The resulting forces acting on the balance arm 50 (as shown in FIG. 7) are represented by boom compression vector AA, boom live mast compression vector BB, balance arm compression vector CC, and hoist line compression vector MM. The sum of the vertical components AAv, BBv, MMv, and CCv are equal to the tower compression force vector F. The sum of the horizontal forces AAh, BBh, MMh and CCh equal zero when the boom hoist lines 94 and backstay lines 100 are vertical. When boom hoist lines 94 and backstay lines 100 are not vertical but forward there is a net horizontal force II which is opposed by tension in tower pendant 20. Therefore, the sum of force II and force 20*h* equals zero at C. The boom hoist lines 94 and backstay lines 100 must not be backward because the tower pendant 20 cannot oppose a force in compression. The net vertical forces acting on the tower cap 34 are opposed by compression force vector F acting at the center of the tower and distributed evenly to the tower chords by the tower cap 34.

Although the best mode contemplated for carrying out the present invention has been herein shown and described, it will be apparent that modification and variation may be made without departing from what is regarded to be the subject matter of the invention.

I claim:

1. In a tower crane comprising a lower works, an upper works pivotally connected to said lower works for rotation about a vertical axis, a tower having front chords and having rear chords, said tower pivotally connected to said upper works for rotation about a horizontal axis, means to hold said tower in a vertical position, a balance arm pivotally mounted on said tower, said arm engaging said tower only on a laterally extending pivot axis midway between the front chords of the tower and the rear chords of the tower, a boom pivotally connected to the front end of said balance arm for swinging movement between a lowermost position along said tower and an elevated position, a live mast pivotally connected at one end to said balance arm, a pendant connected between the other end of said live mast and the boom, wherein the improvement comprises means including a backstay line to connect the rear end of said balance arm to said upper works independent of any connection to the tower to maintain the balance arm in a substantially horizontal operating position on said tower when the tower is in a vertical position, and reeving connected between said other end of said live mast and the rear end of said balance arm to control the attitude of said boom.

2. The apparatus of claim 1 wherein said live mast is connected to the balance arm in the vertical transverse plane of said laterally extending axis.

3. In a tower crane comprising a lower works, an upper works pivotally connected to said lower works for rotation about a vertical axis, a tower having front chords and having rear chords, said tower pivotally connected to said upper works for rotation about a horizontal axis, means to hold said tower in a vertical position, a balance arm pivotally mounted on said tower, said arm engaging said tower only on a laterally extending pivot axis midway between the front chords of the tower and the rear chords of the tower, a boom pivotally connected to the front end of said balance arm for swinging movement between a lowermost position along said tower and an elevated position, a live mast pivotally connected at one end to said balance arm, a pendant connected between the other end of said live mast and the boom, wherein the improvement comprises means including a backstay line to connect the rear end of said balance arm to said upper works independent of any connection to the tower to maintain the balance arm in a substantially stationary operating position on said tower with a major portion thereof extending rearwardly of said tower when the tower is in a vertical position, in any operating position of the boom between said lowermost position and said elevated position, and reeving connected between said other end of said live mast and the rear end of said balance arm to control the attitude of said boom.

4. In a tower crane comprising a lower works, an upper works pivotally connected to said lower works for rotation about a vertical axis, a tower having front chords and having rear chords, said tower pivotally connected to said upper works for rotation about a horizontal axis, means to hold said tower in a vertical position, a balance arm pivotally mounted on said tower, said arm engaging said tower only on a laterally extending pivot axis midway between the front chords of the tower and the rear chords of the tower, a boom pivotally connected to the front end of said balance arm for swinging movement between a lowermost position along said tower end an elevated position, a mast pivotally connected at one end to said balance arm, adjustable lines and reeving having portions operatively connected between the other end of said mast and said balance arm and between said mast other end and said boom to swing the boom relative to the balance arm, wherein the improvement comprises means including a backstay line to connect the rear end of said balance arm to said upper works independent of any connection to the tower to maintain the balance arm in a substantially stationary operating position on said tower with a major portion thereof extending rearwardly of said tower when the tower is in a vertical position, in any operating position of the boom between said lowermost position and said elevated position.

* * * * *

UNITED STATES PATENT AND TRADEMARK OFFICE

CERTIFICATE OF CORRECTION

PATENT NO. : 4,159,776

DATED : July 3, 1979

INVENTOR(S) : CARL F. HOLTER

It is certified that error appears in the above—identified patent and that said Letters Patent is hereby corrected as shown below:

Column 1, line 20: change "3,300,361" to --"3,300,061"--;

Column 2, line 47: change "of" to --for--;

Column 3, line 58: change "backstay" to --backstays--;

Signed and Sealed this

*Nineteenth* Day of *May 1981*

[SEAL]

*Attest:*

RENE D. TEGTMEYER

*Attesting Officer*

*Acting Commissioner of Patents and Trademarks*